United States Patent [19]

Wytko

[11] 4,403,729

[45] Sep. 13, 1983

[54] FILE FOLDER BOX

[75] Inventor: Richard Wytko, Olympia, Wash.

[73] Assignee: Weyerhaeuser Company, Tacoma, Wash.

[21] Appl. No.: 402,019

[22] Filed: Jul. 26, 1982

Related U.S. Application Data

[63] Continuation of Ser. No. 284,426, Jul. 20, 1981, abandoned, and Ser. No. 358,981, Mar. 17, 1982, Pat. No. 4,373,660.

[51] Int. Cl.[3] ..... B65D 5/10; B65D 5/22

[52] U.S. Cl. ..... 229/39 R; 229/33; 229/44 R

[58] Field of Search ..... 229/39 R, 44 R, 45 R, 229/33, 41 B

[56] References Cited

U.S. PATENT DOCUMENTS

| | | | |
|---|---|---|---|
| 2,074,314 | 3/1937 | Fleischer . | |
| 2,220,388 | 11/1940 | Beaman et al. . | |
| 2,332,250 | 10/1943 | O'Reilly | 229/41 B |
| 2,610,782 | 9/1952 | McReary | 229/33 |
| 2,747,732 | 5/1956 | Fischer | 229/44 R |
| 2,809,777 | 10/1957 | Davidson | 229/45 R |
| 2,918,205 | 12/1959 | Zeitter | 229/45 |
| 3,063,615 | 11/1962 | Bronte et al. . | |
| 3,178,093 | 4/1965 | Wasyluka . | |
| 3,285,492 | 11/1966 | Demby et al. . | |
| 3,286,900 | 11/1966 | Keith . | |

*Primary Examiner*—Herbert F. Ross

[57] ABSTRACT

A container in which the container walls, the bottom closure, the reinforcing panels and the cover are unitary. The closure tab on the front closure flap is inserted into an aperture in the front panel and extends between the front panel and the front reinforcing panel.

11 Claims, 8 Drawing Figures

FILE FOLDER BOX

RELATED APPLICATION

This is a continuation-in-part of my copending U.S. Pat. Applications Ser. Nos. 284,426 filed July 20, 1981, now abandoned, and 358,981 filed Mar. 17, 1982 now Pat. No. 4,373,660.

BACKGROUND OF THE INVENTION

1. Field of the Invention

A reinforced storage container in which the reinforcing is also part of the cover lock.

2. Other Disclosures

There are many patents showing reinforced side walls on containers. Exemplary of these are Fleischer, U.S. Pat. Nos. 2,074,314 issued Mar. 16, 1937; Bronte, et al, 3,063,615, issued Nov. 13, 1962, Demby, et al, 3,285,492, issued Nov. 15, 1966; and Keith, 3,286,900, issued Nov. 22, 1966. Other patents disclose reinforcing around the upper rim of containers. Exemplary of these are Beaman, et al, 2,220,388, issued Nov. 5, 1940; and Wasyluka, 3,178,093, issued Apr. 13, 1965.

SUMMARY OF THE INVENTION

The present invention provides a container in which the container walls, the bottom closure, the reinforcing panels, and the cover are unitary. It also provides a container which may be shipped in lay-flat condition to the customer and stored in such condition until used. It may then be erected and formed without the aid of machinery.

This is particularly useful for shipping and storage containers such as small containers used by transfer and storage companies or record and file folder storage containers. These must be in inventory for use when needed, but are not an item that is regularly used. In such instances a large inventory must be kept on hand and the ability to store in a lay-flat condition reduces the space required for the containers. The fact that the container, the reinforcing panels and the cover are unitary eliminates the usual problems of having and storing separate elements. When a single container is picked up, all the elements required are there.

These containers would be used occasionally and do not lend themselves to machine formation. They must easily be formed by hand. The present container has this capability.

It also provides a container in which one of the reinforcing panels also becomes part of the cover closure of the container. A closure tab on the front closure flap is inserted through an aperture in the front panel and extends between the front panel and the front reinforcing panel.

BRIEF DESCRIPTION OF THE DRAWINGS

FIG. 5 shows the container with the side reinforcing panels in place and FIG. 6 shows the container with both the side reinforcing panels and the front reinforcing panels in place.

FIG. 7 is a view from the top and FIG. 8 is a view from the bottom.

DESCRIPTION OF THE PREFERRED EMBODIMENT

Figure 1:
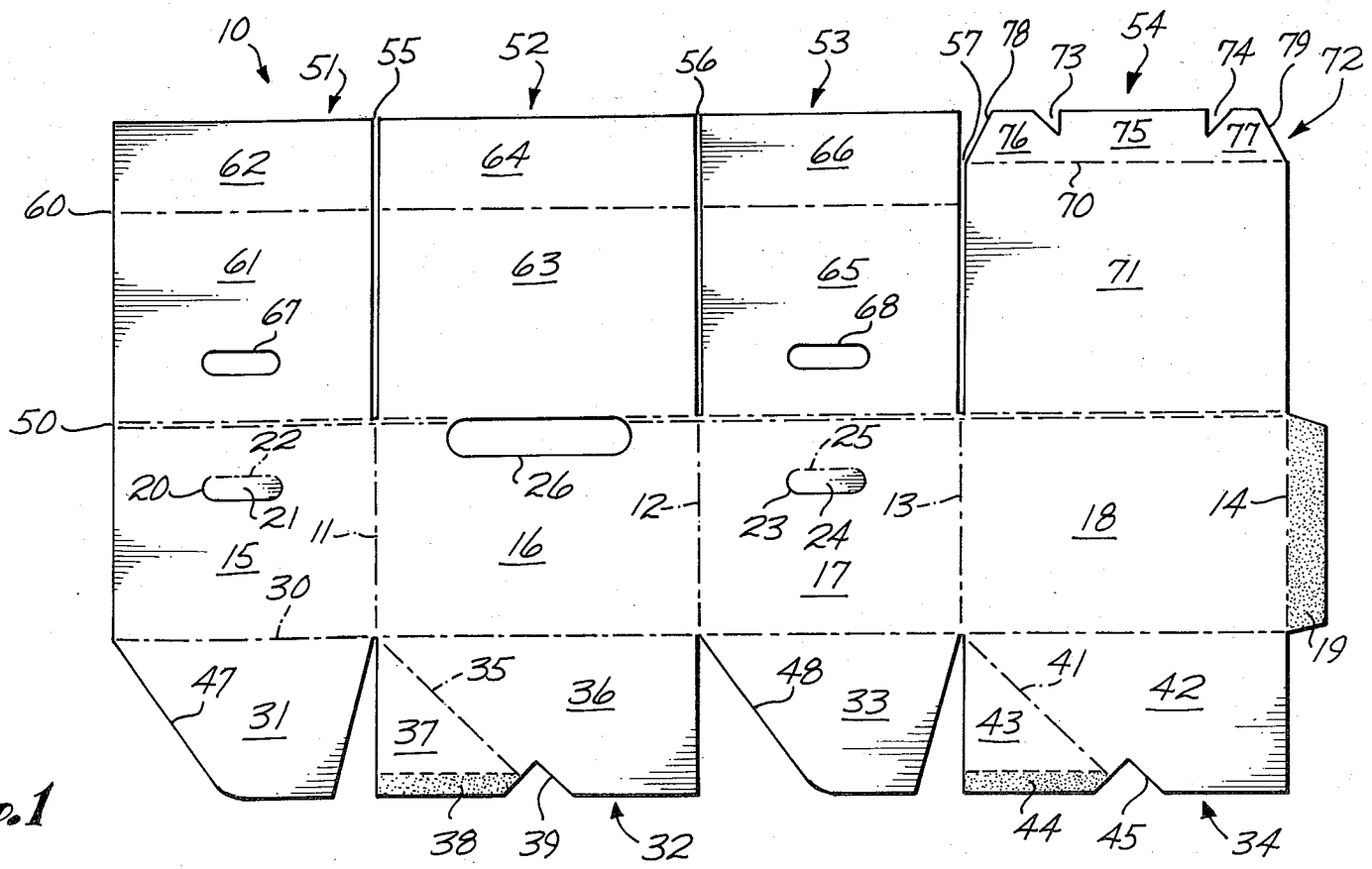
FIG. 1 is a top plan view of a blank for the container.

Blank 10 is divided by score lines 11, 12, 13 and 14 into a first side panel 15, a front panel 16, a second side panel 17, a back panel 18 and a glue flap 19. The first side panel 15 has a hand hold 20 formed by hand hold flap 21 which is hinged to the first side panel 15 by upper score line 22. The second side panel 17 has a corresponding hand hold 23 formed by hand hold flap 24 which is hinged to the second side panel 17 by upper score line 25. The front panel 16 has a cover securing apertire 26 along its upper edge.

The score line 30 defines the lower edge of the first side panel 15, the front panel 16, the second side panel 17 and the back panel 18. The bottom closure panels of the container are hinged to these panels along the score line 30. The bottom closure panel 31 is hinged to first side panel 15 along score line 30. The bottom closure panel 32 is hinged to the front panel 16 along score line 30. The bottom closure panel 33 is hinged to second side panel 17 along score line 30 and bottom closure panel 34 is hinged to back panel 18 along score line 30.

The style of bottom closure shown is a self-closing closure so that no additional tape or staples are needed to form the bottom closure of the container. The bottom closure panel 32 is divided by a diagonal score line 35 into a main body section 36 and a fold section 37. The lower outer edge of fold back section 37 has a glue strip 38. The lower edge of bottom closure panel 32 has a triangular relief 39 at its approximate midpoint.

The glue strips 38 and 44 are representative of the glue applied to the fold back section 37 and 43. In actual practice glue will be applied to a major portion of the fold back sections.

The reliefs 39 and 45 allow the interlocking of the bottom closure panels 32 and 34 when the container is erected to form an overlapping bottom panel section.

In forming the bottom section of the container, the bottom closure panels 31, 32, 33 and 34 are bent inwardly around score line 30 until they overlie the inner faces of the panels 15, 16, 17 and 18. The fold back section 37 is bent outwardly around score line 35 until it overlies the outer face of main body section 36, and the fold back section 43 is bent outwardly around score line 41 until it overlies the outer face of main body section 42. The panel 15 is then folded around score line 11 over the inner face of front panel 16. In this process the glue strip 38 on fold back panel 37 is adhered to the outer face of bottom closure panel 31. The back panel 18 is folded inwardly around score line 13 over the inner face of second side panel 17. In this process the glue strip 44 on fold back panel 43 is adhered to the outer face of bottom closure panel 33. During this latter process, the glue strip 19 is adhered to the outer face of first side panel 15 to form the lay flat container.

Figure 2:
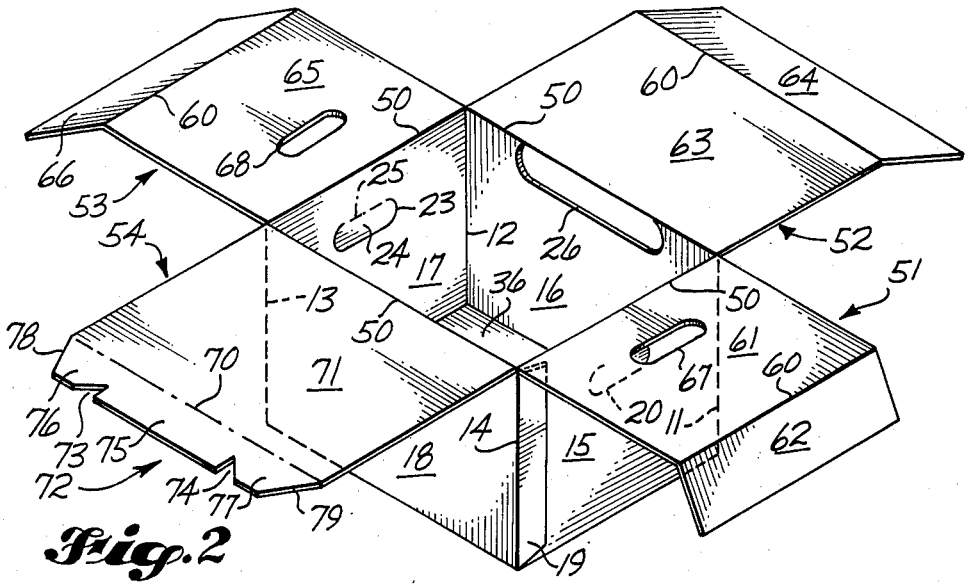
FIG. 2 is an isometric view of the erected container with the reinforcing panel not yet in place.
Figure 3:
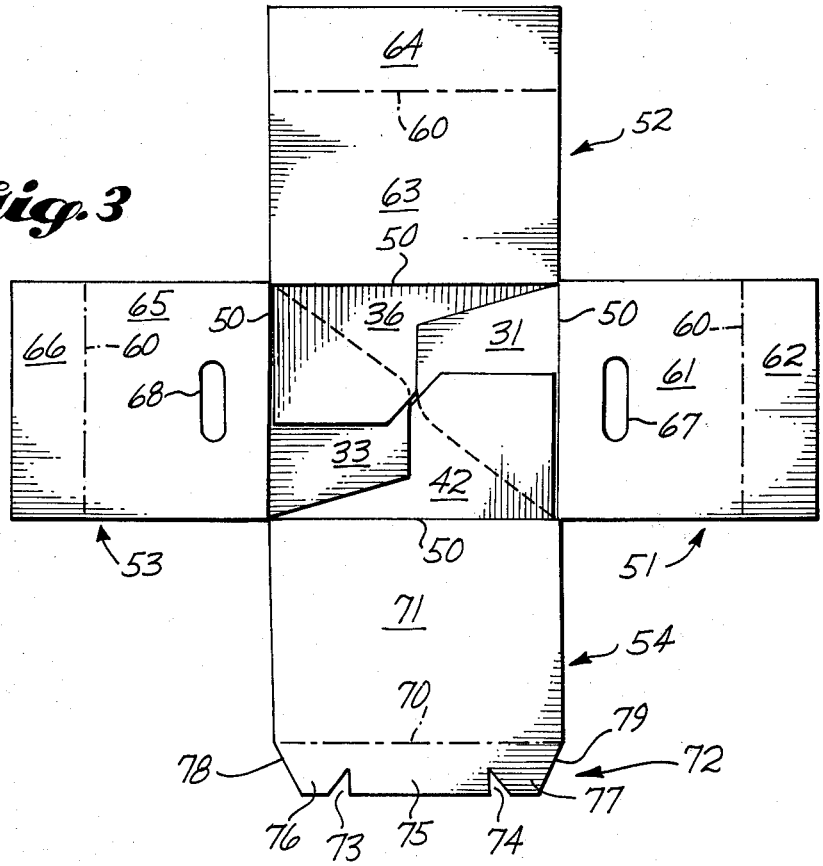
FIG. 3 is a top plan view of the container shown in FIG. 2.
Figure 4:
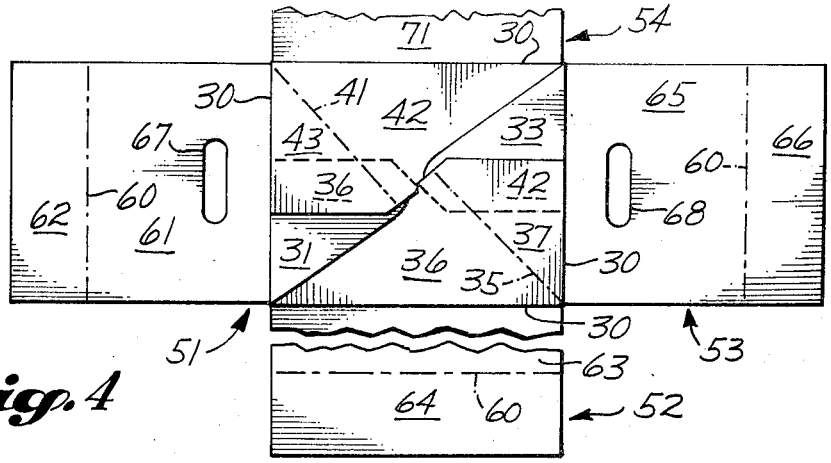
FIG. 4 is a bottom plan view of the container shown in FIG. 2.
Figure 8:
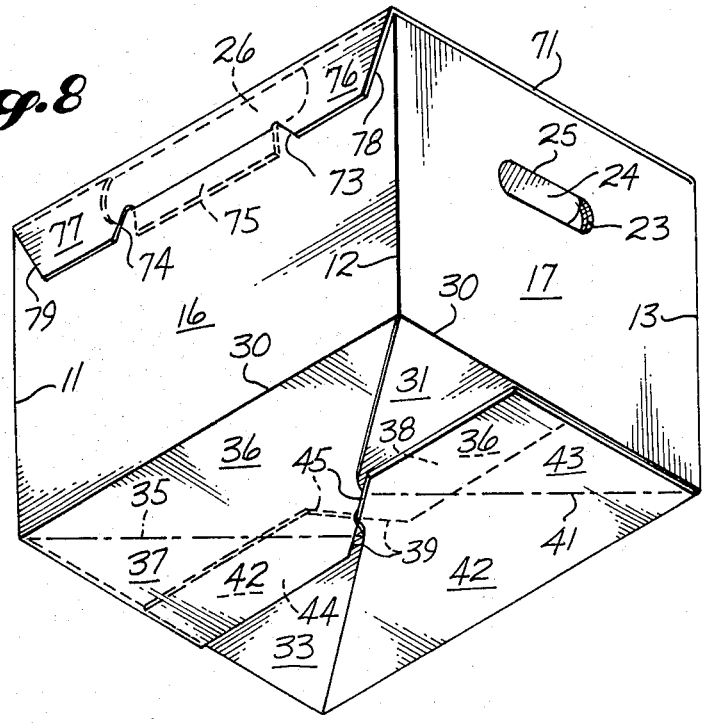

When the front, side and back panels 15, 16, 17 and 18 of the container are squared to form the erect container shown in FIG. 2, the bottom closure panels 31, 32, 33 and 34 automatically form the bottom closure of the container because they are pulled downwardly around score line 30 into the plane of the score line 30. The combined closure panels interlock at reliefs 39 and 45 as shown in FIGS. 3, 4 and 8. The bottom closure panels 31 and 33 are beveled along side edges 47 and 48 so they will slide along the opposite bottom closure panels and not hang up in the container during closure.

Other bottom closure configurations may be used.

The reinforcing panels and top closure are attached to the upper edges of the panels 15, 16, 17 and 18 along the double score line 50. The first side reinforcing panel 51 is hinged to the first side panel 15. The front reinforcing panel 52 is hinged to the front panel 16. The second side reinforcing panel 53 is hinged to the second side panel 17 and the top closure panel 54 is hinged to the back panel 18. The reinforcing panels 51, 52 and 53 and the cover panel 54 are separated from each other by slots 55, 56 and 57. The slots 55, 56 and 57 are in alignment with score lines 11, 12 and 13.

Each of the three reinforcing panels is divided into two sections by score line 60. The first side reinforcing panel 51 is divided into a first side reinforcing section 61 and a first bottom reinforcing section 62. The front reinforcing panel 52 is divided into a front reinforcing section 63 and a third bottom reinforcing section 64. The second side reinforcing panel 53 is divided into a second side reinforcing section 65 nad a second bottom reinforcing section 66.

The first side reinforcing section 61 has a hand hold aperature 67 which is aligned with the hand hold aperture 20 in the first side panel in the formed container. The second side reinforcing section 65 has a hand hold aperture 68 which is aligned with the hand hold aperture 23 in the second side panel 17 in the formed container.

Figure 5:
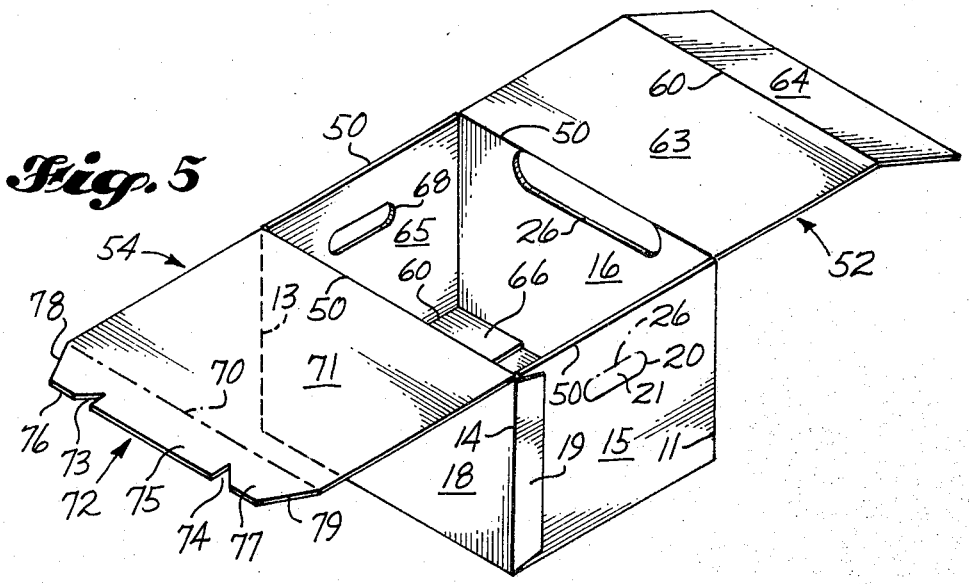
FIGS. 5 and 6 are isometric views of the container being formed.
Figure 6:
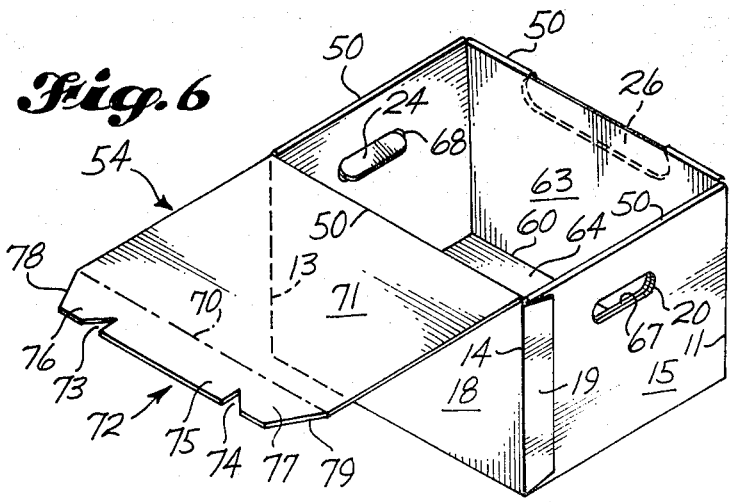

After the container has been erected as shown in FIGS. 2, 3 and 4, the reinforcing sections are placed into the container as shown in FIGS. 5 and 6.

The first and second side reinforcing panels 51 and 53 are first placed into the container as shown in FIG. 5. The first side reinforcing section 61 is contiguous and coestensive with the first side panel 15 and the first bottom reinforcing section 62 extends along the bottom closure of the container. The second side reinforcing section 65 is contiguous and coextensive with second side panel 17 and the second bottom reinforcing section 66 extends along the bottom closure of the container.

The front reinforcing panel 52 is then folded into the container. The front reinforcing section 63 is contiguous and substantially coextensive with the front panel 16. The width of front reinforcing section 62 is slightly narrower that the front panel 16 to allow it to be placed into the container between the side reinforcing section 61 and 65. Consequently, it is at least two material thicknesses narrower than the front panel 16.

The third bottom reinforcing section 64 extends along the bottom of the container over the first and second bottom reinforcing sections 62 and 66. In the panel 52 the score line 60 is offset from the score line 60 in panels 51 and 53 a distance that allows the third bottom reinforcing section 64 to be over the first and second bottom reinforcing sections 62 and 66. Consequently, it is offset the width of the material forming the container.

In the present design, the blank is substantially rectangular. However, in some instances the first and second bottom reinforcing sections would be of a length that would allow them to meet in the middle of the container provide a two-ply bottom closure. The third bottom reinforcing section 64 could, if necessary, be designed to be coextensive with the bottom of the container to provide a three-ply bottom closure.

The bottom reinforcing panels may be reversed with the first and second bottom reinforcing panels extending over the third reinforcing panel. This would also change the order in which the side reinforcing panels are placed in the container.

The top closure panel 54 is divided by score line 70 into a cover panel 71 which is coextensive with the top of the container and a front closure flap 72. The closure flap 72 is divided by relief sections 73 and 74 in its outer edge into a central closure tab 75 and outer tabs 76 and 77. The sides of the closure flap 72 are beveled at 78 and 79.

Figure 7:
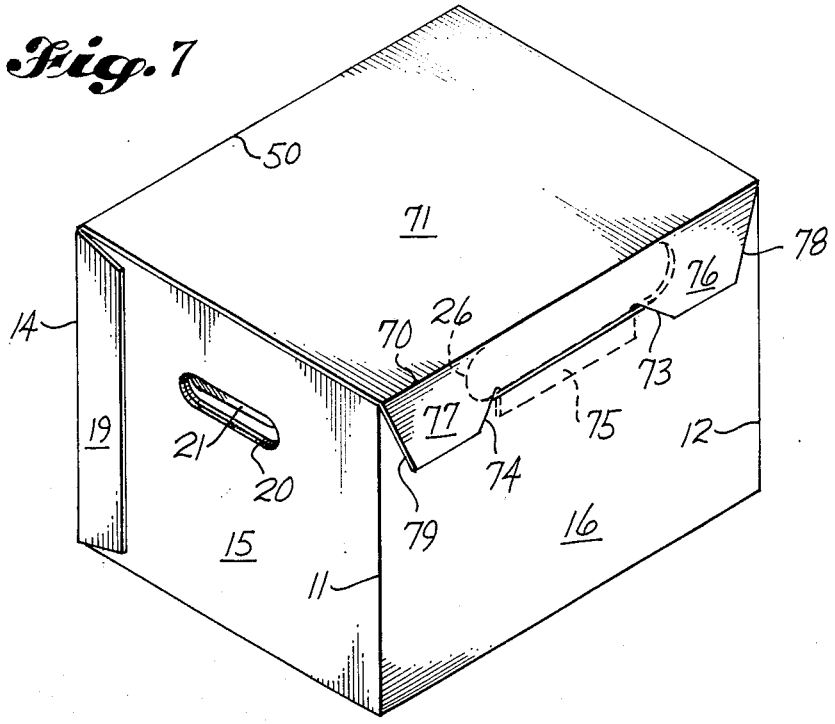
FIGS. 7 and 8 are isometric views of the closed container.

In closing the container the cover panel 71 is bent over the top of the container around score line 50 and the front closure flap 72 is bent downwardly around score line 70. The central closure tab 75 has a horizontal length at least slightly less than the horizontal length of aperature 26 so that the tab may be inserted through the aperture 26 in the front panel 16, and a width greater than the width of the aperture 26. The distance between score line 70 and the inner edge of closure tab 75 is equal to or slightly less than the distance between score line 50 and the lower edge of aperture 26, and the distance between score line 70 and the outer edge of closure tab 75 is greater than the distance between score line 50 and the lower edge of aperture 26 so that the tab extends downwardly below aperture 26 between front panel 16 and the front reinforcing section 63. The outer tabs 76 and 77 are on the outer face of front panel 16 as shown in FIGS. 7 and 8.

The hand holds are formed by pushing the hand hold flaps 21 and 24 inwardly into the container through the hand hold apertures 67 and 68.

The usual material for this container is double walled corrugated.

I claim:

1. A container blank comprising first, second, third and fourth panels serially connected by score lines, means for connecting said first and fourth panels in the completed container, bottom closure panels extending from selected lower edges of said first, second, third and fourth panels, two of said first, second, third and fourth panels having similar dimensions and being opposed side walls in the erect container, the other two of said first, second, third and fourth panels having similar dimensions and being opposed front and back panels in the erect container, a front reinforcing panel having the same height as said back panel and being hingedly attaced by a score line to the upper edge of said front panel, an aperture through the outer face of said front panel, a cover panel extending from the upper edge of the back panel and being hinged to said back panel along a score line, a front closure flap hinged to the outer edge of said cover panel, said front closure flap having a closure tab having a length substantially equal to the length of said front panel aperture, the distance between said front closure flap hinge and the inner edge of said closure tab being less than the distance between said front reinforcing panel hinge and the lower edge of said front aperture, and the distance between said front closure flap hinge and the outer edge of said closure tab being greater than the distance between said front reinforcing panel hinge and the lower edge of said front aperture.

2. The container blank of claim 1 further comprising the length of said front reinforcing panel being substantially equal to the height of said front panel and the width of said front reinforcing panel being substantially equal to the width of said front panel.

3. The container blank of claim 2 further comprising a bottom reinforcing panel attached to the outer edge of said front reinforcing panel.

4. The container blank of claim 1 further comprising said reinforcing panels hingedly attached by a score line to the upper edge of said side panels.

5. The container blank of claim 4 further comprising said side reinforcing panels having a length substantially equal to the height of said side panels and a width substantially equal to the width of said side panels.

6. The container blank of claim 5 further comprising bottom reinforcing panels hingedly attached to the outer edge of said side reinforcing panels.

7. The container blank of claim 1 further comprising side reinforcing panels hingely attached by a score line to the upper edge of said side panels, said side reinforcing panels having a length substantially equal to the height of said side panels and a width substantially equal to the width of said side panels, bottom reinforcing panels hingedly attached to the outer edge of said side reinforcing panels, the length of said front reinforcing panel being substantially equal to the height of said front panels less the thickness of said bottom reinforcing panels and the width of said front reinforcing panel being substantially equal to the width of said front panel less the thickness of said side reinforcing panels, a third bottom reinforcing panel hingedly attached to the outer edge of said front reinforcing panel.

8. A container comprising a first, second, third and fourth panel serially connected by score lines, means for connecting said first and fourth panels, a bottom closure extending along the lower edges of said first, second, third and fourth panels, two of said first, second, third and fourth panels having similar dimensions and being opposed side walls of the container, the other two of said first, second, third and fourth panels having similar dimensions and being opposed front and back walls of the container, a front reinforcing panel having the same height as said back panel and hingedly attached to the upper edge of said front panel extending into said container along the inner face of said front panel, an aperture through the outer face of said front panel, a cover panel extending hinged to and from the upper edge of said back panel across the upper edges of said first, second, third and fourth panels, a front closure flap hinged to the outer edge of said cover panel and extending downwardly over the outer of said front panel, a closure tab extending through said aperture downwardly between said front panel and said front reinforcing panel.

9. The container of claim 8 in which side reinforcing panels are hinged to the upper edges of said side panels and extend downwardly into the container along the inner face of said side panels.

10. The container of claim 9 in which bottom reinforcing panels are hinged to the lower edges of said front and side reinforcing panels, said side bottom reinforcing panels extending along the bottom closure and said front bottom reinforcing panel extending over said side bottom reinforcing panels.

11. The container of claim 9 in which bottom reinforcing panels are hinged to the lower edges of said front and side reinforcing panels, said front bottom reinforcing panel extends along the bottom closure and said side bottom reinforcing panels extend over said front bottom reinforcing panel.

* * * * *

UNITED STATES PATENT AND TRADEMARK OFFICE

CERTIFICATE OF CORRECTION

PATENT NO. : 4,403,729

DATED : September 13, 1983

INVENTOR(S) : Richard Wytko

It is certified that error appears in the above—identified patent and that said Letters Patent is hereby corrected as shown below:

In column 6, line 15, "extending hinged to and" should read -- hinged to and extending --;

In column 6, line 19, "outer of" should read -- outer face of --;

Signed and Sealed this

*Sixth* Day of *December 1983*

[SEAL]

*Attest:*

GERALD J. MOSSINGHOFF

*Attesting Officer*

*Commissioner of Patents and Trademarks*